US006865757B2

(12) United States Patent
Hennessy

(10) Patent No.: US 6,865,757 B2
(45) Date of Patent: Mar. 15, 2005

(54) ASYMMETRICAL HAMMOCK SHELTER

(76) Inventor: Thomas Hennessy, 637 Southwind Road, Galiano Island, BC (CA), V0N 1P0

( * ) Notice: Subject to any disclaimer, the term of this patent is extended or adjusted under 35 U.S.C. 154(b) by 0 days.

(21) Appl. No.: 10/336,852

(22) Filed: Jan. 6, 2003

(65) Prior Publication Data

US 2003/0196265 A1 Oct. 23, 2003

Related U.S. Application Data

(60) Provisional application No. 60/344,371, filed on Jan. 4, 2002.

(51) Int. Cl.[7] ..... A45F 3/22
(52) U.S. Cl. ..... 5/120; 5/122
(58) Field of Search ..... 5/120–123, 127; D6/386, 387

(56) References Cited

U.S. PATENT DOCUMENTS

| | | | | | |
|---|---|---|---|---|---|
| 25,625 | A | * | 10/1859 | Palmer | 224/602 |
| 751,907 | A | * | 2/1904 | Furst | 5/122 |
| 1,181,508 | A | * | 5/1916 | Davis | 5/122 |
| 4,021,868 | A | | 5/1977 | Fueslein | |
| 4,941,453 | A | | 7/1990 | Shakas et al. | |
| 6,185,763 | B1 | * | 2/2001 | Hennessy | 5/120 |

* cited by examiner

*Primary Examiner*—Alexander Grosz
(74) *Attorney, Agent, or Firm*—Shoemaker and Mattare

(57) ABSTRACT

A hammock includes a bed made of a piece of flexible material gathered by folding at opposite ends. Ropes are attached to the gathered ends whereby the bed can be suspended from trees. The edges of the bed are drawn apart along a tension axis which is diagonal to the suspension axis, giving the bed the shape of a non-equilateral polygon so that one can lie diagonally across the suspension axis, whereby the back is well supported.

16 Claims, 7 Drawing Sheets

ASYMMETRICAL HAMMOCK SHELTER

This application claims priority from provisional U.S. Patent Application 60/344,371, filed Jan. 4, 2002.

BACKGROUND OF THE INVENTION

This invention relates to hammocks, particularly one in which a person lies diagonally across the suspension axis of the hammock.

For camping and other recreational activities, different hammocks have been developed to provide shelter from insects, ground dwelling creatures and inclement weather. When suspended above the ground, hammocks provide more comfortable, dry, warm and clean sleeping surfaces than do tents.

It is known that hammocks are quite comfortable for lounging during the day or a few hours, but are not satisfactory for getting a good night's rest because of the stiffness and soreness that results from having one's lower back bent into an unnatural curve during the night. The human spine is not straight, but rather curves in opposite directions in a gentle "S" shape. As the occupant relaxes his muscles while sleeping, the convex curve of the upper spine fits the shape of the hammock, but the gentle concave curvature at the base of the spine is forced by gravity to conform to the opposite, convex curve of the hammock. This is known as the "banana position" and after several hours or an entire night, lower back pain may develop, as thousands of soldiers can attest from having slept lengthwise in conventional narrow jungle hammocks.

The Mayans, who used the hammock as their traditional bed for centuries, discovered that the form of the bed would change from a curved shape lengthwise to an almost straight bed when one rested diagonally or crosswise to the longitudinal suspension axis. They used uncovered, woven mesh hammocks and the lengthwise strands of woven material would follow the shape of the occupant's anatomy when he lay crosswise. This would have the effect of a comfortable contoured mattress such as modern foam or spring mattress which is flat when not occupied, but compresses to conform to the shape of the individual when laid upon.

Hammocks until now have been manufactured in a symmetrical shape. By this I mean that the shape of the hammock on one side of the suspension axis is the mirror image of the shape on the other side.

The perseverance of the symmetrically-shaped hammock may be explained by the simplicity of manufacture on traditional hammock looms and by the perception that the hammock was already too simple a product and comfortable enough to discourage further innovation or more efficient use of materials.

When one tries to lie diagonally on a conventional hammock to straighten his back, the head and feet move closer to the edges of the hammock bed. In the case of a hammock covered with a mosquito net and rain fly (which covers the bed and has a slightly larger extent in all directions), the head and feet become exposed to the sun, wind and rain. Thus, conventional shelter design discourages an occupant from lying diagonal to the suspension axis of the hammock.

Hammocks having rectangular and trapezoidal shapes are known. They tend to restrict movement of the arms and hands and they do not comply with the requirement that at the middle of the hammock, where the occupant is wider, the hammock must be wider as well. All such hammocks provide a supporting surface which is concave, no matter how tightly the hammock is tied.

SUMMARY OF THE INVENTION

The above problems are solved by making a hammock bed non-symmetrical, e.g., one which has a non-equilateral polygon shape when viewed from above. A person lies diagonally across the suspension axis of the hammock, and in doing so is not supported in a concave fashion; actually, the lower back is supported in a way accommodating its natural curvature.

The present invention is directed broadly, to a hammock having a bed whose shape is asymmetric with respect to its suspension axis, that is, the longitudinal axis defined by connections to the support ropes at each end of the hammock.

The bed can be formed from a rectangular sheet of material, but a non-rectangular asymmetric quadrilateral shape is preferred, as asymmetric shapes improve the opportunities to adjust the size and proportion of the hammock to differences in the human anatomy.

The bed may include a closure mechanism which allows the sides of the hammock to be drawn around the occupant to enclose him in a wind-proof and heat retaining cocoon at night, similar to a suspended bivy sack shelter. The closure mechanism could be hooks and lacing, Velcro, a hook and loop fastener, or a zipper.

For comfort, the material used for the bed preferably is a stretchy nylon or similar fabric. Nylon fabric stretches approximately 11%–15% and when an occupant moves onto the diagonal across these elastic fibers, these fibers stretch around the bulges of the anatomy and also support the concave areas of the torso, such as the lower spine.

In one form of the invention, the shape of the short sides of the fabric bed can be adjusted before folding. After the length of hammock fabric and the ridge line length are established, the shape of the fabric across the bottom of the hammock can be adjusted by changing the shape of the ends of the fabric A concave angle or curve cut into one or both ends would have the effect of raising the middle of the hammock relative to its sides. A convex angle or curve cut into the ends of the hammock would have the effect of lowering the bottom of the hammock relative to its sides. Such modifications allow one to adjust for different occupant weights using the same fabric. A lighter occupant might prefer a hammock with a slightly lower profile, while a heavy occupant who would stretch the fabric more might prefer a hammock with its bottom adjusted upwards for less sag and improved back support.

In another embodiment, the distance that the lateral tension points are offset in opposite directions on either side of the suspension axis, and the resulting angle and leg lengths on each side of the suspension axis are also important factors determining the form and comfort of an asymmetrical hammock.

A further refinement of the asymmetrically shaped hammock is to use asymmetrically shaped pieces of material for the fabric bed. The adjustment of the lengths of each of the fabric bed's sides allows further refinements of shape to improve comfort, fit and economy. To improve balance for the occupant, making one side of the hammock longer than the other allows the occupant's lower torso, which generally weighs less than the upper torso, to project further to one side of the hammock and still remain balanced. Location of the occupant is an especially important factor when dealing with balance and weight distribution, which differ between men and women.

A second benefit of adjusting the lengths of the sides of the hammock is that less fabric is required at the end of the hammock where the occupant's body is narrower, that is, in the area around his legs and feet. This also results in a weight savings of the finished product.

After establishing the direction of the diagonal axis of the hammock bed, because the occupant will lie only in one direction on this new axis and will not be as comfortable lying diagonally in the other direction, it may be advantageous to increase the number of folds of fabric on one side of the suspension axis and to decrease the number of folds of fabric on the other side of the suspension axis in the reverse order at each end of the hammock bed to make better use of the fabric on the side of the hammock which will not be used by the occupant. When the number of folds of fabric is increased on the side of the hammock intended for the occupant, usable space will increase on that side and will provide an improvement in comfort for the occupant.

According to the present invention, a hammock bed is formed from a sheet of fabric material whose ends are folded into a bundle. Each bundle of gathered folds is in turn connected to ropes used to suspend the hammock between anchors such as trees. Details of the folds and the way in which the ropes are attached may be found in U.S. Pat. No. 6,185,763.

BRIEF DESCRIPTION OF THE DRAWINGS

In the accompanying drawings:

FIGS. 1–3 show a conventional prior hammock. In each figure, the primary tension elements (ropes 10 and 12) are intended to be tied between two trees, and to form a suspension axis running lengthwise of the hammock.

In FIGS. 1*a* and 1*b*, an occupant is resting lengthwise in the hammock, with his back bent. The natural concave recurve at the base of the human spine is urged toward an opposite convex curve by the hammock. Deformation progresses while the occupant is asleep, his muscles being relaxed and gravity at work.

Figure 1A:
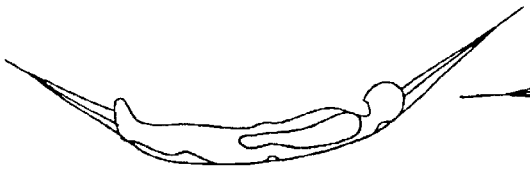
Fig. 1a (PRIOR ART)
FIGS. 1*a* and 1*b* are, respectively, front elevation and top plan views of a conventional prior hammock.
Figure 1B:
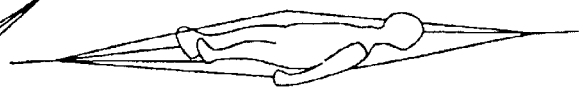
Fig. 1b (PRIOR ART)
Figure 2A:
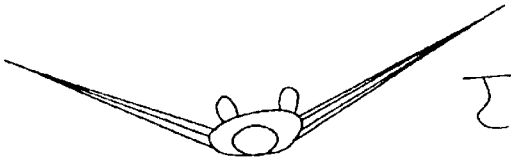
Fig. 2a (PRIOR ART)
FIGS. 2*a* and 2*b* show a person lying across the prior hammock, perpendicular to the longitudinal suspension axis of the hammock defined by the supporting ropes at either end.
Figure 2B:
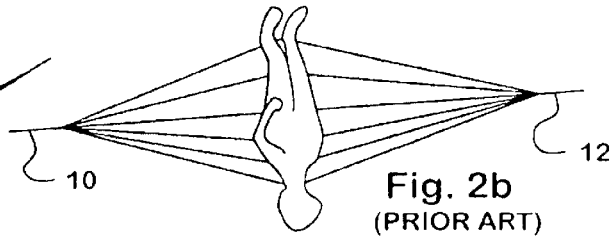
Fig. 2b (PRIOR ART)

As FIGS. 2*a*–2*b* show, when the occupant lies directly across the bed, his spine is now straight instead of curved as in FIG. 1. This position would be very comfortable on the back if the fabric were wide enough to support his head and feet. The curve of the occupant's back now more closely conforms to the width of his body, and under tension, the elastic fabric stretches to conform to shape of occupant's torso, including the important recurve at the base of the spine.

Figure 3A:
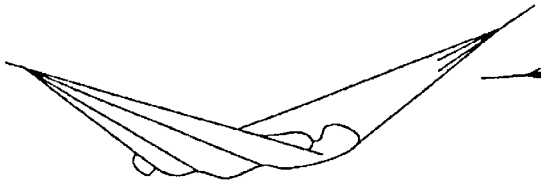
Fig. 3a (PRIOR ART)
FIGS. 3*a* and 3*b* show the person lying diagonally across the prior hammock.
Figure 3B:
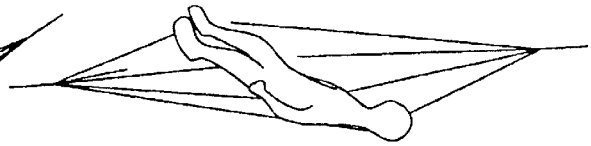
Fig. 3b (PRIOR ART)

By lying diagonally (FIGS. 3*a*–3*b*), one can maintain a straight body position as in FIGS. 2*a*–2*b*, and this orientation makes more efficient use of the width of the fabric. However, the spread shape of the hammock is defined by the weight of the occupant. In this position, the head and feet, while better supported, are too close to two of the sides of the hammock, and there is excess space on either side of the body.

Figure 4:
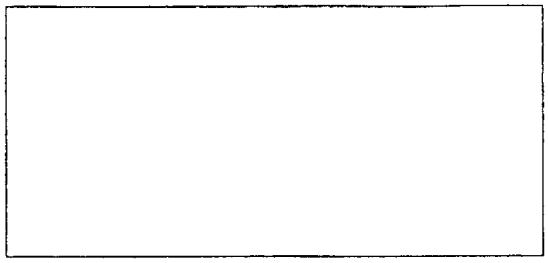
Fig. 4 (PRIOR ART)
FIG. 4 is a plan view of a piece of sheet material from which a bed according to the present invention may be made.

FIG. 4 shows a rectangular piece of sheet material (e.g., nylon or polyester fabric) from which a hammock bed may be made.

Figure 6:
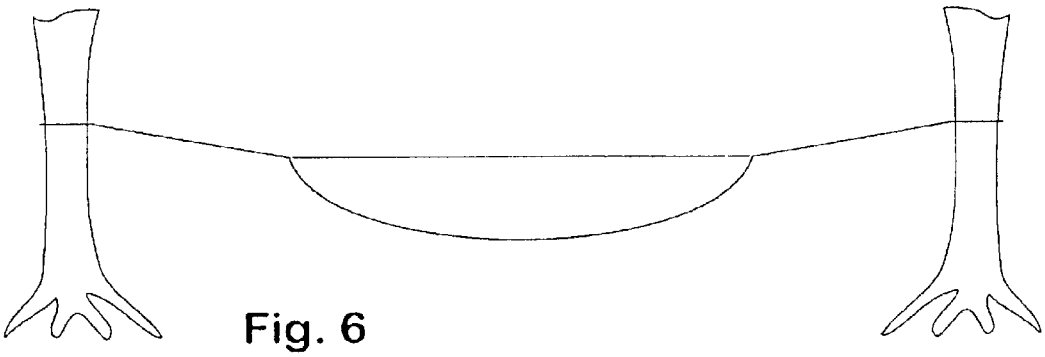
Fig. 6 (PRIOR ART)
FIG. 6 is a side elevation of the bed, showing substantial sag in the middle.
Figure 5:
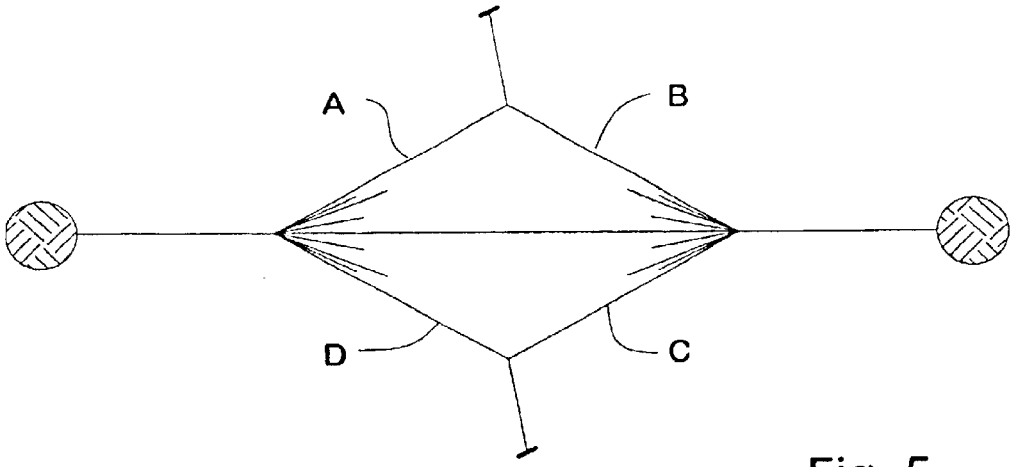
Fig. 5 (PRIOR ART)
FIG. 5 is a plan view showing the material, having been folded at its ends to form a parallelogram-shaped bed.

In FIG. 5, the ends of the material have been gathered into folds, and ropes have been attached to the folded material. The bed is suspended between trees and sagged to a preferred chord distance of approximately 102" (2.59 meters, FIG. 6) between the folded ends of fabric. This distance may be maintained by providing a ridge line of the proper length running between the ends of the bed. The four edge segments of the bed have lengths designated A, B, C, D.

The hammock beds show in FIGS. 7–10 all have same ridge line length, and are all made from the material shown in FIG. 4. In each case, half of the fabric lies on either side of the suspension axis "S" of the bed. In each case, the sum of segments A+B is 120 inches (3 meters), and the sum of segments C+D is 120 inches.

Figure 7:
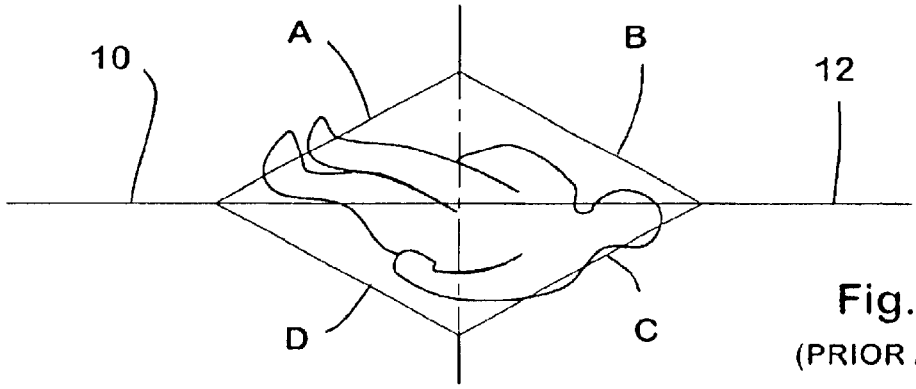
Fig. 7 (PRIOR ART)
FIGS. 7–12 show variations of the bed, all formed from the piece of material shown in FIG. 4.

The hammock of FIG. 7 is symmetrical (A=B=C=D); if the fabric is folded about the suspension axis, its edges meet at all points. However, as one can see from FIG. 7, when the occupant lies diagonally for comfort in a symmetrical hammock—even though it is held open with tension cords—there is excess space on either side of the body, while the head and feet hang uncomfortably over the other edges of the bed.

DESCRIPTION OF THE PREFERRED EMBODIMENTS

The present invention, various forms of which are illustrated in FIGS. 8–22, is an improvement over the symmetrical hammocks of FIGS. 1–7.

Figure 8:
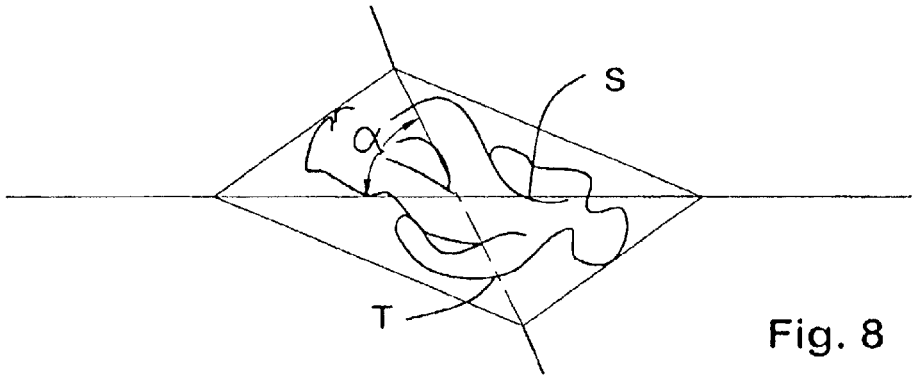
Figure 9:
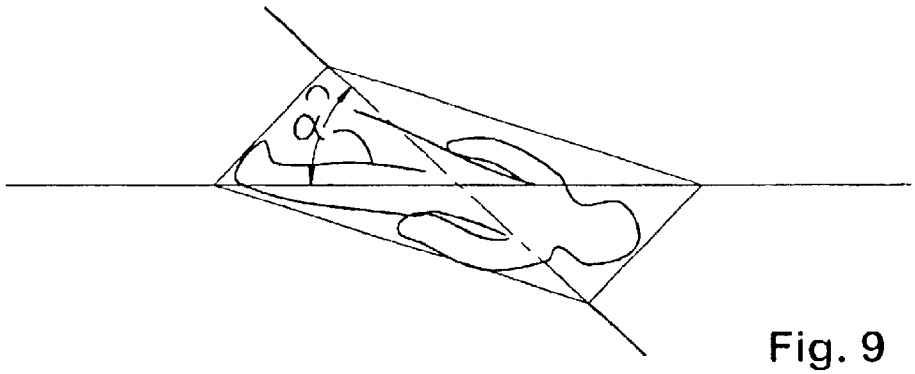
Figure 10:
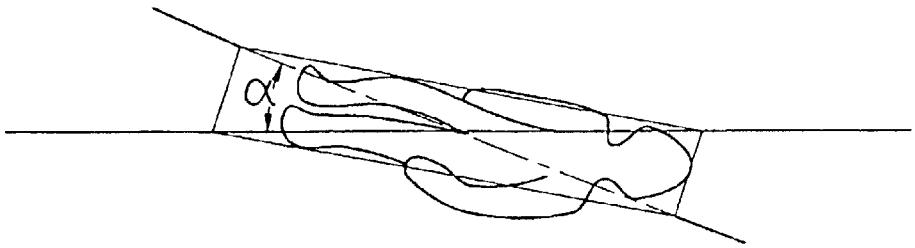
Figure 11:
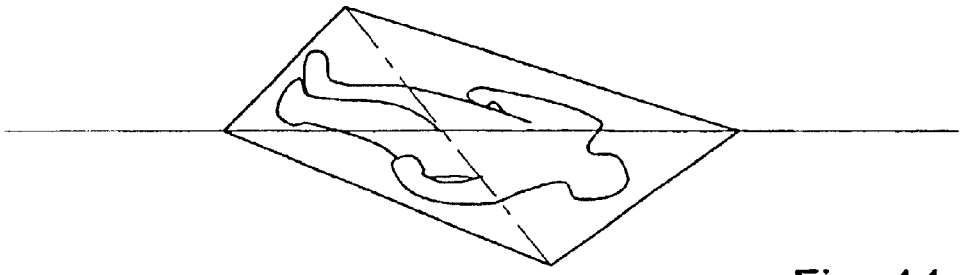

As FIGS. 8–10 show, as the shape of the bed is modified by shifting the lateral tension points of the hammock in opposite directions so that the tension axis is progressively more diagonal to the suspension axis, the bed effectively becomes longer and narrower. This reallocation of space within the hammock provides an improved geometric fit to the occupant, up to a point. In FIG. 8, the occupant has a knee near one corner of the hammock and an elbow near the other corner. His head and feet are acceptably inside the new perimeter shape of hammock bed. The opposite lateral corners of the bed are near the knee to foot of the occupant, and his head to elbow, respectively, and form a parallelogram. When a rain fly of a similar proportion (but slightly greater size) is positioned above the hammock, it provides improved protection for the occupant, especially near his head and feet, which were previously exposed.

In FIG. 9, the situation is further improved: the occupant now rests comfortably fully extended on the diagonal without overhanging the sides. The angle $\alpha$ between the suspension axis "S" and the tension axis "T" here is between 35° and 65°, which range I presently consider optimum.

By FIG. 10, the lateral tension points have been shifted too far. The bed is now too narrow, and unnecessarily long.

In FIGS. 8–10, the bed shapes were parallelograms (A=C and B=D). In the embodiments of FIGS. 11–18, however, the bed shapes are not parallelograms.

FIG. 1, for example, is a modification of FIG. 9, still within the optimum range. Even though there is the same total edge length on each side of the suspension axis, the segment lengths are all different. The lateral tension points have been displaced lengthwise unequally to more accurately accommodate the body shape, considering that a person is widest at the shoulders. The resulting shape is similar to the proportions of a conventional mummy style sleeping bag or the classic pine box coffin.

Figure 12:
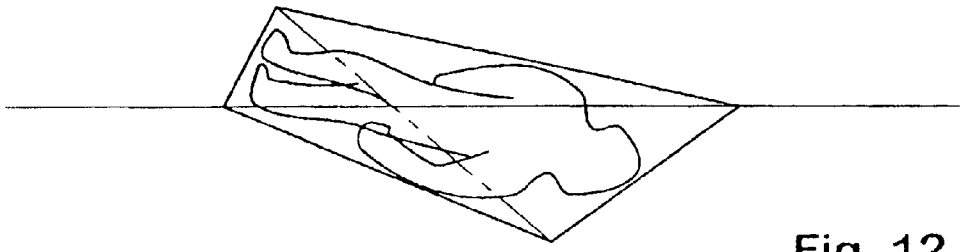

FIG. 12 is a further modification which allows both feet to extend more comfortably while narrowing the hammock only slightly.

Figure 13:
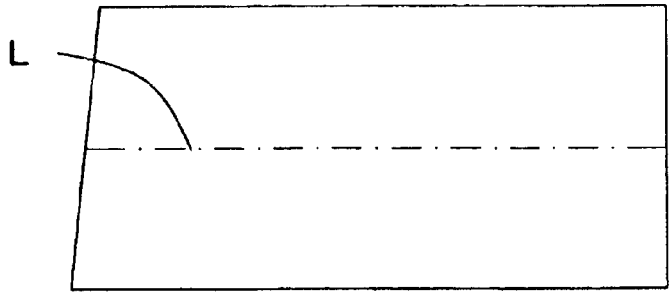
FIGS. 13–18 illustrate bed made of pieces of fabric which are quadrilateral, but not rectangular.
Figure 14:
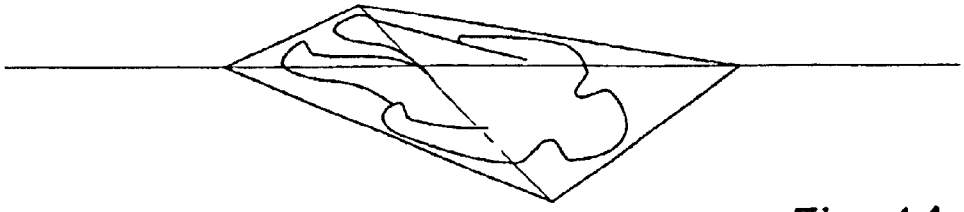

FIG. 13 shows a modification in which the piece of fabric from which the hammock bed is made is cut six inches (0.15 meter) shorter on one of its long sides. There are equal amounts of fabric on either side of the center line "L". The resulting hammock is shown in FIG. 14. Now there are different total segment lengths on either side of the suspension axis (A+B≠C+D). The fabric has been folded to the center line at each end, and sags from a ridge line 102" (2.59 meters) long, with ropes and side tension cords attached. The resulting hammock protrudes more to one side, allowing the lower half of the occupant's torso to extend further on that side than the heavier upper torso on the other side.

Figure 15:
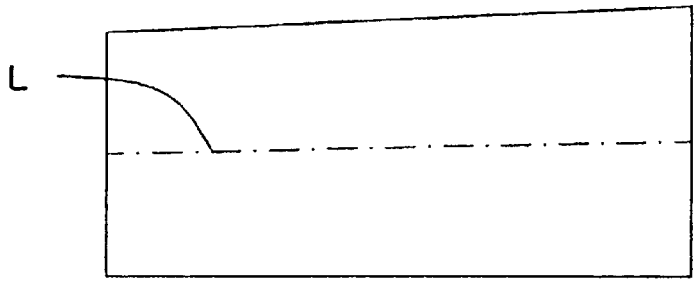

FIG. 15 shows another piece of fabric, this one having ends of unequal length, resulting in a hammock having fewer folds at the end of the hammock accommodating the legs. Again, the centerline bisects the fabric.

Figure 16:
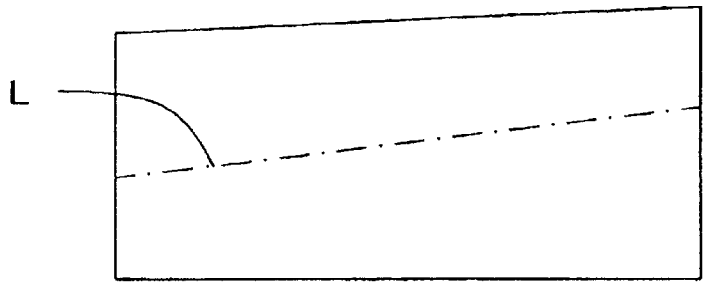

In FIG. 16, the fabric has both a shorter side and a shorter end, thus combining the features of FIGS. 13 and 15. The resulting hammock has both more perimeter on one side of the hammock, with fewer folds of fabric and less width at one end for the legs.

Figure 17:
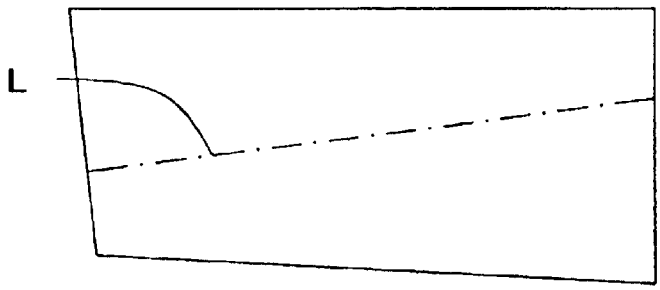

FIG. 17 shows the relocation of the point at which the folds from each side of the hammock meet. The point on each end of the fabric toward which the fabric is folded has been moved off center. This causes the bundle on one side to contain more fabric and the bundle on the other side to contain less fabric. The preferred location of this point is determined by establishing the balance point of an average occupant from head to foot. Unlike the previous embodiments, here, the centerline is offset to one side of the hammock.

Figure 18:
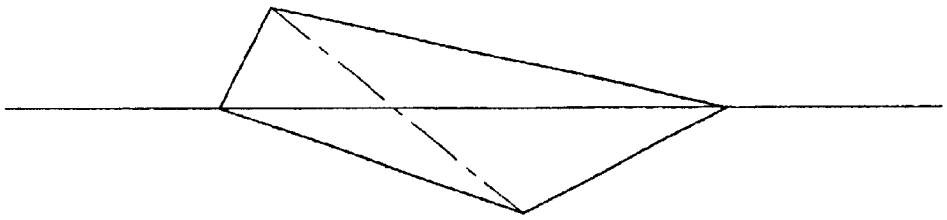

FIG. 18 shows another variation, in which an asymmetrically shaped hammock is cut from an asymmetrically shaped piece of fabric with an asymmetric point at each hammock end to which the fabric is folded. As shown by the fold marks at each end of hammock, 75% of folds are on the widest side of the hammock at each end and that 25% of folds are on the narrowest side of the hammock at each end. This combination of all three asymmetries (unequal short side lengths, unequal long side lengths, unequal fabric folding at ends) provides a hammock fabricator with a range of adjustments, thus allowing asymmetrical hammocks to be custom designed for occupants of specific weights and proportions.

The table below shows the segment lengths and resulting axis intersection angles of FIGS. 7–12, 14 and 18.

Figure 19:
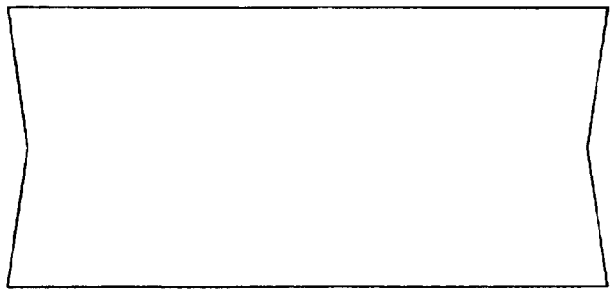
FIGS. 19 and 20 are views of pieces of material having parallel sides, but non-linear ends.
Figure 20:
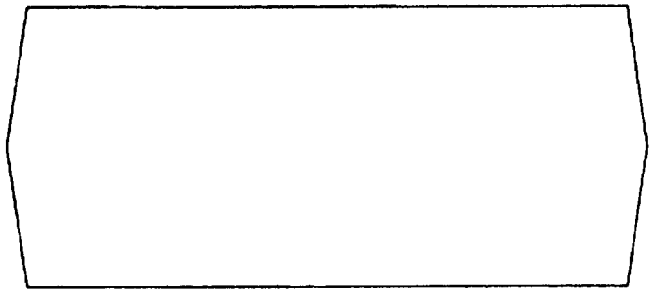

| Fig. No. | A (inch) | B (inch) | C (inch) | D (inch) | α (degrees) |
|---|---|---|---|---|---|
| 7 | 60 | 60 | 60 | 60 | 90 |
| 8 | 48 | 72 | 48 | 72 | 65 |
| 9 | 36 | 84 | 36 | 84 | 44 |
| 10 | 20 | 100 | 20 | 100 | 23 |
| 11 | 36 | 84 | 48 | 72 | 50 |
| 12 | 24 | 96 | 48 | 72 | 43 |
| 14 | 30 | 78 | 48 | 72 | 47 |
| 18 | 24 | 96 | 48 | 66 | 41 |

in any of the hammocks described above, the ends of the fabric may be modified to affect the effective depth of the hammock. In FIG. 19, a concave angle or curve is cut into one or both ends to raise the middle of the middle of the hammock relative to its sides. Conversely, a convex angle or curve (FIG. 20) may be provided to lower the bottom of the hammock relative to its sides.

Figure 21:
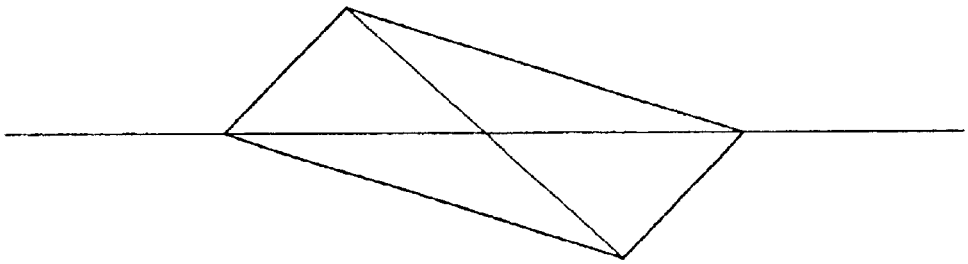
FIG. 21 shows a bed provided with a stay extending across a diagonal to spread the bed fabric.

FIG. 21 depicts a spreader bar or stay in compression between asymmetric corners. The stay replaces the function of side tension cords. The spreader bar may be made expandable lengthwise, in order to maintain the tension on the asymmetric corners of an overhanging rain fly.

Figure 22:
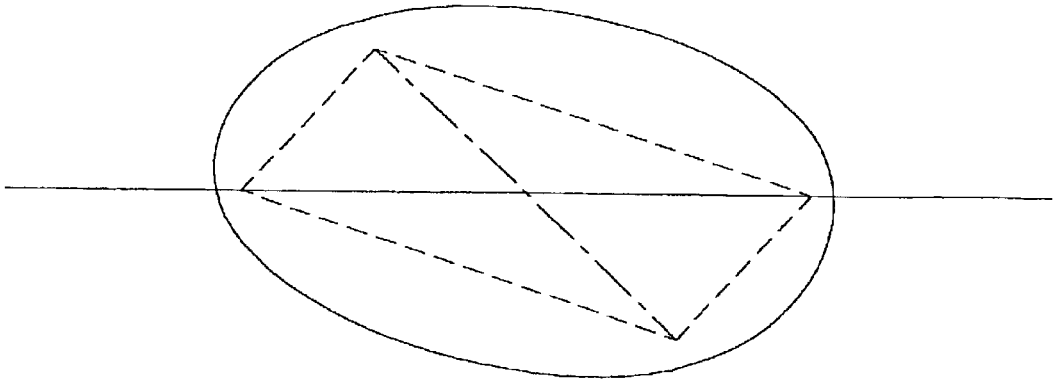
FIG. 22 shows a hammock bed made from a symmetric oval piece of material, but having tension points which make it asymmetric in function.

While the invention has been described above as having a bed with an asymmetric shape, it should be noted that, actually, the outline of the piece of material from which the bed is made is not particularly important. What matters is the shape of that portion of the piece of material which is placed under tension by the primary and secondary tension devices, that is, the weight-supporting area, which is a polygon whose vertices are the tension points. For example, one could make a bed functionally identical to that of FIG. 9, from a much larger piece of material. To illustrate, FIG. 22 shows such a modification, where the peripheral outline of the material is oval, but the area under tension (broken lines) has the shape of a parallelogram. The area outside the parallelogram is substantially tension-free in use, and does not contribute to the functional properties (e.g., strength, comfort) of the hammock. A skilled person would rightly expect the beds of FIGS. 9 and 22 to be substantially identical in performance, and would appreciate that the area outside the parallelogram in FIG. 22 is wasted from a functional standpoint; nevertheless, the extra material could conceivably contribute to the attractiveness of the hammock, and thus might be commercially important. The extra material may also serve other purposes, for example, to provide storage pockets, or to provide extra covering that can be pulled over the occupant.

Also, while I have described a hammock in which the suspension ropes are connected directly to the bed fabric, it would be possible to have intermediate connectors, e.g., cords, between the ropes and the fabric.

Since the invention is subject to these and other modifications and variations, it is intended that the foregoing description and the accompanying drawings shall be interpreted as only illustrative of the invention defined by the following claims.

I claim:

1. A hammock comprising a bed made of sheet material, only two suspension elements for supporting the hammock, the suspension elements being connected to the bed at spaced primary tension points defining a single suspension axis, and at least two lateral tension elements, for stretching the bed, connected to the bed at spaced lateral tension points defining a tension axis, said lateral tension points being asymmetric to one another about said suspension axis, whereby the tension axis is diagonal to the suspension axis.

2. The invention of claim 1, wherein said piece of sheet material is substantially rectangular before being gathered at opposite ends, and said suspension points are at said opposite gathered ends.

3. The invention of claim 1, wherein said tension points define a quadrilateral.

4. The invention of claim 3, wherein the quadrilateral has sides all of different lengths.

5. The invention of claim 3, wherein the quadrilateral has a first pair of sides on one side of the suspension axis and a second pair of sides on the other side of the suspension axis, said first pair of sides having a greater total length than said second pair of sides.

6. The invention of claim 3, wherein the lateral tension points define a tension axis, and the quadrilateral has a first pair of sides on one side of the tension axis and a second pair of sides on the other side of the tension axis, said first pair of sides having a greater total length than said second pair of sides.

7. A method of hanging a hammock having a bed made of a piece of sheet material, said method comprising steps of gathering said sheet material at opposite ends, suspending the hammock between a pair of trees by tying each of said gathered opposite ends to a single respective one of said trees forming a single suspension axis, and pulling lateral edges of the material away from each other at points which are longitudinally offset from one another so as to give the bed a shape of a non-equilateral polygon.

8. The method of claim 7, wherein the pulling step includes attaching a lateral tension cord to each of said lateral edges at said respective longitudinally offset points.

9. The method of claim 7, wherein said points define a lateral tension axis which diagonally crosses said suspension axis.

10. The method of claim 9, wherein said tension axis crosses said suspension axis at an angle between 35° and 80°.

11. The method of claim 10, wherein said angle is between 45° and 65°.

12. A hammock comprising a bed having a single suspension axis defined by points at which suspension ropes are attached, and means for holding the bed open by applying lateral tension to the bed at lateral tension points on either side of the suspension axis, wherein the lateral tension points are disposed asymmetrically about the suspension axis.

13. The hammock of claim 12, wherein the bed has a perimeter, half of which lies on either side of the suspension axis.

14. The hammock of claim 12, wherein the bed has a perimeter, unequal portions of the perimeter lying on either side of the suspension axis.

15. The hammock of claim 12, wherein the bed is made of a length of material which is folded at either end, the folds being connected to the respective suspension ropes, at least one end being folded asymmetrically to accommodate taper and weight distribution of the torso.

16. The hammock of claim 15, wherein different amounts of fabric are folded into each set of folds at the respective ends of the hammock.

* * * * *